US005460291A

United States Patent [19]

Kerstiens

[11] Patent Number: 5,460,291

[45] Date of Patent: Oct. 24, 1995

[54] TRANSPORT CONTAINER FOR TEXTILE PACKAGES

[75] Inventor: Peter Kerstiens, Aachen, Germany

[73] Assignee: W. Schlafhorst AG & Co., Moenchengladbach, Germany

[21] Appl. No.: 182,797

[22] Filed: Jan. 14, 1994

[30] Foreign Application Priority Data

Jan. 19, 1993 [DE] Germany ..... 43 01 211.6

[51] Int. Cl.[6] ..... B65D 8/02

[52] U.S. Cl. ..... 220/629; 220/578; 220/529

[58] Field of Search ..... 206/817, 388; 220/578, 579, 580, 529, 629, 625, 628, 631, 4.33, 409, 527, 693

[56] References Cited

U.S. PATENT DOCUMENTS

| | | | |
|---|---|---|---|
| 1,717,320 | 6/1929 | Victor | 206/817 |
| 2,015,653 | 10/1935 | Andrews | 206/388 |
| 5,205,402 | 4/1993 | Maeda | 206/817 |
| 5,320,263 | 6/1994 | Kobylack | 206/817 |
| 5,333,359 | 8/1994 | Kroupa | 206/388 |

FOREIGN PATENT DOCUMENTS

| | | | |
|---|---|---|---|
| 508363 | 10/1992 | European Pat. Off. . | |
| 2451296 | 5/1976 | Germany | 206/817 |
| 8812622 | 3/1990 | Germany . | |
| 691140 | 7/1965 | Italy | 220/578 |

*Primary Examiner*—Stephen J. Castellano
*Attorney, Agent, or Firm*—Herbert L. Lerner; Laurence A. Greenberg

[57] ABSTRACT

A transport container for textile packages, especially sliver, includes a vertically displaceable bottom element and a wall surrounding the bottom element and having a given length. The wall is formed of at least two joined-together wall parts being extended over all of the given length. The wall has guide gaps formed therein over large portions of the given length, for guidance of the bottom element. The transport container preferably has a rectangular outline.

19 Claims, 4 Drawing Sheets

TRANSPORT CONTAINER FOR TEXTILE PACKAGES

BACKGROUND OF THE INVENTION

Field of the Invention

The invention relates to a transport container for textile packages, especially sliver, wherein the transport container has a preferably rectangular outline and a vertically displaceable bottom element.

It is conventional to supply the spinning stations of open-end spinning machines, for instance, with feed sliver, which is deposited in spinning cans having a round cross section. Such round cans as a rule are made of plastic, and in order to ensure that the sliver will be deposited on the drawing frame gently, they have a spring-loaded can bottom. The filled round cans are retrieved from the drawing frame or card by a transport vehicle, transported to the spinning stations of the open-end spinning machine, and there exchanged for spinning cans that have run empty. Since the diameter of such round cans is greater than the width of the spinning stations at which the sliver is processed, the spinning cans have to be placed in at least two rows one after the other in the region of the spinning stations.

Since spinning cans that have run empty should be replaced with spinning cans having new feed material as immediately as possible, a "random changing" system is employed. The can changing process proves to be relatively complicated, especially if the change is to be made automatically and the can to be changed is located in the back row.

Attempts have therefore already been made in the past to simplify the can changing operation by using flattened spinning cans.

German Petty Patent G 88 12 622 and German Published, Non-Prosecuted Applications DE 40 15 938 A1 and DE 40 18 088 A1 have described the use of such flattened spinning cans in the transport system including the drawing frame and the open-end spinning machine.

Such spinning cans, for instance those known from German Published, Non-Prosecuted Application DE-OS 25 17 344, are adjusted in their width to the width of the spinning station of the applicable spinning machine, so that all of the spinning cans equipped with feed material can be positioned side by side, to enable avoiding having a second, back row of spinning cans. Although the use of flattened spinning cans that are ready for the spinning station has simplified the can changing operation in the region of the spinning stations, it has been found that such spinning cans have certain disadvantages. For instance, handling of such transport devices in the region of the drawing frame or card may be unsatisfactory.

Transport containers with other than a round outline, for instance rectangular ones, are also known, for instance from German Published, Prosecuted Applications DE-AS 11 07 566 and 15 10 248, German Published, Non-Prosecuted Application DE-0S 19 23 621, or German Petty Patent GM 76 18 538. Some of those transport containers include many individual parts, and the containers are quite expensive to manufacture.

SUMMARY OF THE INVENTION

It is accordingly an object of the invention to provide a transport container for textile packages, which overcomes the hereinafore-mentioned disadvantages of the heretofore-known methods and devices of this general type and which provides an economical spinning can that is suitable for automated transport and is easily handled.

With the foregoing and other objects in view there is provided, in accordance with the invention, a transport container for textile packages, especially sliver, comprising a vertically displaceable bottom element; and a wall surrounding the bottom element and having a given length and preferably a rectangular outline, the wall being formed of at least two joined-together wall parts being extended over all of the given length, and the wall having guide gaps formed therein over large portions of the given length, for guidance of the bottom element.

The use of two joined-together, preferably identical wall parts that extend over the entire length of the wall offers the advantage, among others, of enabling components to be manufactured economically. Moreover, producing vertical guides for the bottom element is quite simple, since corresponding recesses need merely be provided on the outsides of the wall parts.

In accordance with another feature of the invention, there are provided upper and lower spacer elements between the wall parts, so that a guide gap is created between these spacer elements. The spacer elements are joined to the wall parts either undetachably, for instance by an adhesive connection, or detachably through screw bolts.

In accordance with a further feature of the invention, at least one of the two upper spacer elements has a sliver receiving device into which the end of the sliver can be deposited in a defined fashion at the drawing frame and can optionally be secured as well, after the operation of filling the transport container.

In accordance with an added feature of the invention, at least one of the two lower space elements has means that can be engaged by a manipulator or the like, so that during the can filling operation, transport, or can changing, the transport container can be easily handled at any time.

In accordance with an additional feature of the invention, the bottom element has a lattice-like structure with an outer frame and struts between the frame members. This kind of construction is stable and lightweight. Lateral protrusions are also formed onto the frame of the bottom element and guide the bottom element in the guide gaps of the transport container wall. In the region of the guide gaps, the protrusions have a round construction, and they end in a shaped part that is essentially polygonal. This kind of structure has the advantage, for instance, on one hand of making it possible to pivot the bottom element about its longitudinal axis and in that way to evacuate sliver residues at the bottom, and on the other hand of permitting the bottom element to be securely fixed and lowered in a defined manner at the shaped parts by means of a suitable device, such as the pressure foot of the linear unit of the drawing frame.

In accordance with yet another feature of the invention, the wall parts are made of a thermoplastic. This makes the production of the transport container according to the invention especially economical. Thermoplastics are known to be very strong, which means that the transport containers have a long service life. Moreover, such plastics are highly suitable for mass production.

One suitable production process is injection molding, as an example. Through the use of suitably formed-on ribs and beads, the wall parts made by this process are relatively lightweight yet extremely stable. Moreover, it is highly advantageous for all of the requisite guide segments, bearing edges and the like to be simultaneously included with the wall parts. For instance, longitudinal guides facing outward are disposed in the region of the upper and lower edges of the wall parts, and a bearing edge pointing inward for the bottom element is additionally provided on the lower edge.

In accordance with yet a further feature of the invention, the wall parts are made by expansion of polyurethane. In this process, two hard, relatively thin wall layers and one soft core layer are created. Wall parts produced by this process are also distinguished by low weight, high rigidity, and a long service life.

In accordance with a concomitant feature of the invention, in order for the transport containers or their contents to be identified at any time so that conclusions can be drawn as to the point of production of the sliver, for instance, provision is also made to place data carriers on the transport containers. These may be either encoded or encodable data carriers.

Other features which are considered as characteristic for the invention are set forth in the appended claims.

Although the invention is illustrated and described herein as embodied in a transport container for textile packages, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
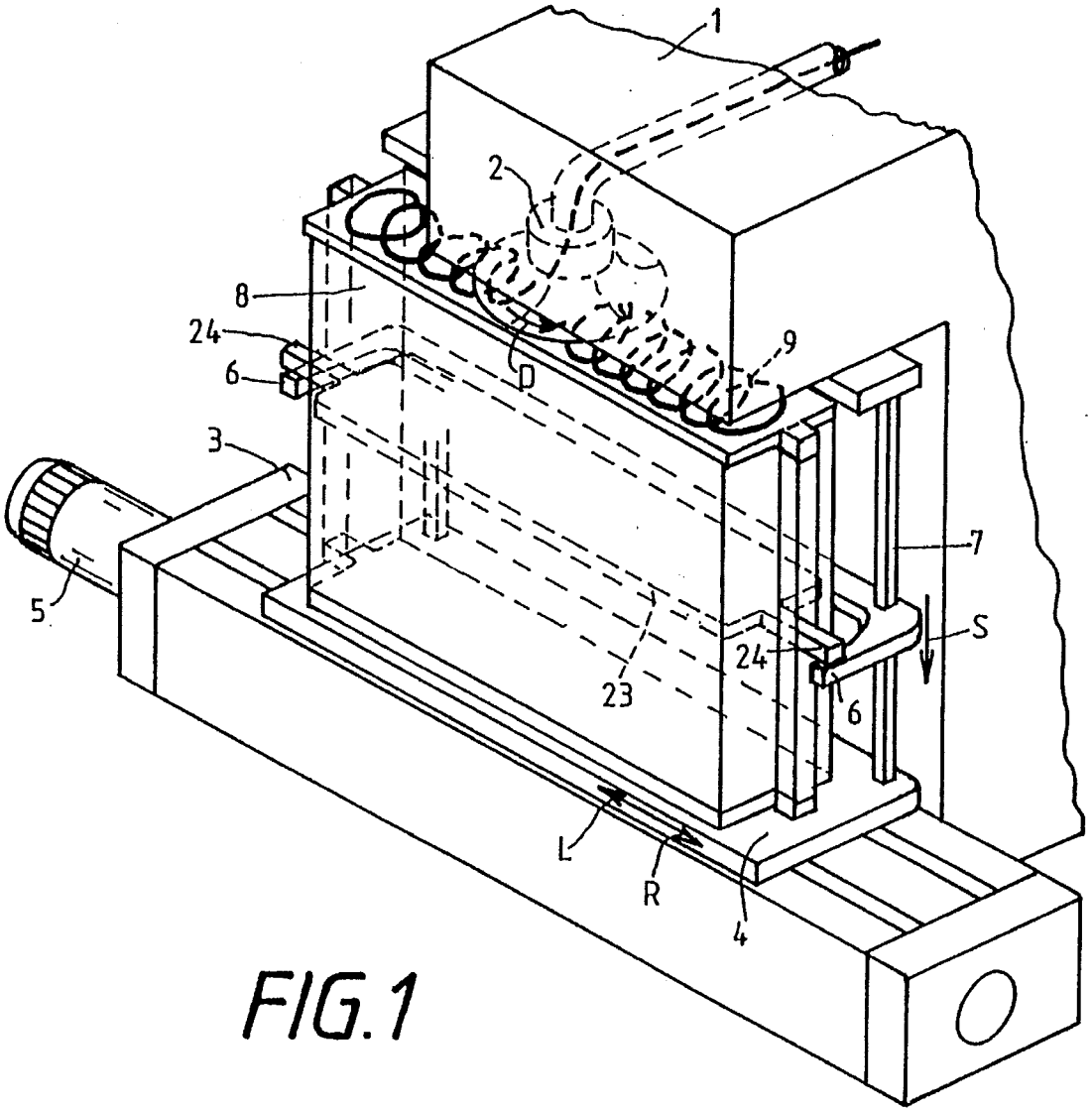
FIG. 1 is a fragmentary, diagrammatic, perspective view of a transport container according to the invention during a filling operation at a drawing frame.

Referring now to the figures of the drawing in detail and first, particularly, to FIG. 1 thereof, there is seen a transport container 8 according to the invention during its loading or filling at a drawing frame 1.

In the usual manner, the drawing frame i has a turntable (coiler) 2 which rotates in a direction D for depositing sliver 9 in loops. A linear unit 3 is disposed upstream of the drawing frame 1, and has a receiving platform 4 that can be oscillatingly moved by a drive mechanism 5 to the right and left, as is indicated by reference symbols R and L. A guide unit 7 with vertically displaceable pressure feet 6 is also disposed on the receiving platform 4. These pressure feet 6 fit below protrusions 24 of a bottom element 23 during the operation of filling the transport container 8, as shown.

The pressure feet 6 assure gentle deposition of sliver in the transport container 8 by defined lowering of the bottom element 23. FIG. 2, which is again a perspective view, shows the transport container 8, that preferably has a substantially rectangular outline. Two identical wall parts 10 are joined together by spacer elements 11–14 and screw bolts 16, in such a way that guide gaps 15 of a width B are created between the wall parts 10. The protrusions 24 of the bottom element 23 are guided in the gaps 15.

Figure 6:
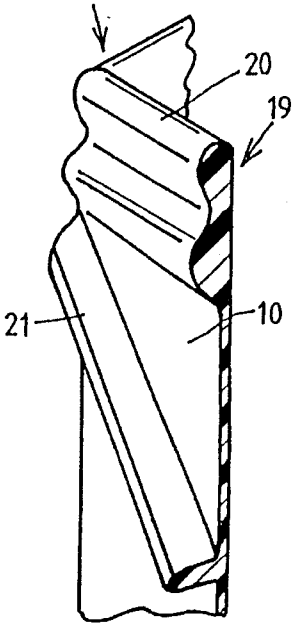
FIG. 6 is an enlarged fragmentary, perspective view of a region of an upper edge of the transport container.

The wall parts 10, which are produced by injection molding, for instance, are made from a thermoplastic. As is suggested in FIGS. 2 and 6, beads 20 and ribs 21 are formed in in order to make the relatively large wall segments more rigid. Longitudinal guides 19 are also provided in the region of an upper edge 17 and a lower edge 18. An inward-pointing bearing edge 22 for the bottom element 23 is also disposed in the region of the lower edge 18, as is seen in FIG. 7.

Figure 7:
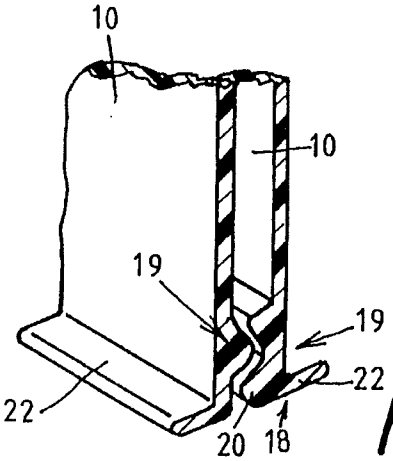
FIG. 7 is a fragmentary, perspective view of lower edges of two transport containers disposed side by side.

As is suggested in FIG. 7, the longitudinal guides may also be constructed in such a way that they intermesh with one another when the transport containers are placed side by side.

Figure 8:
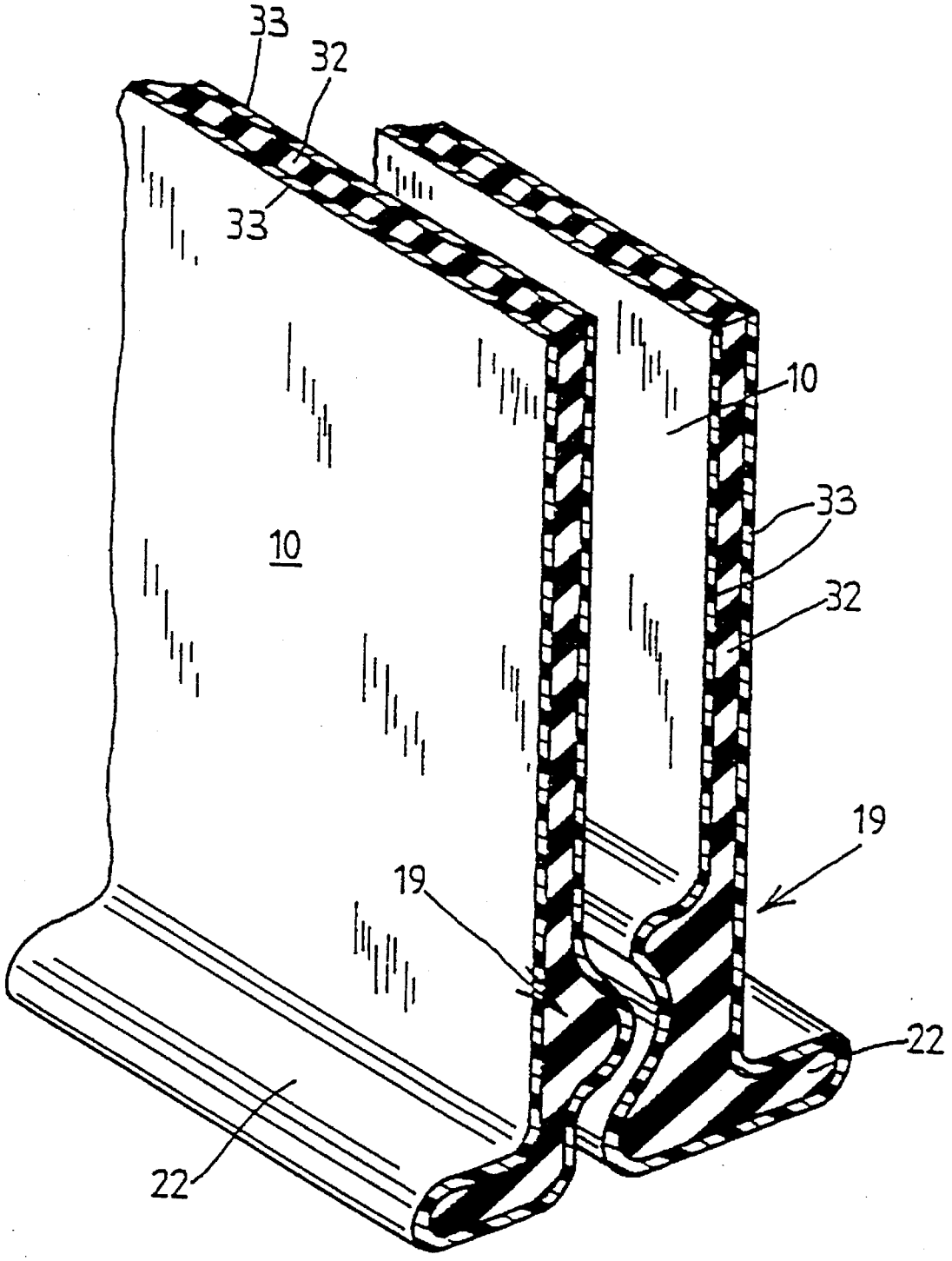
FIG. 8 is a similar view of an alternate embodiment.

With reference to FIG. 8, it is also possible for the wall parts 10 to be made by expansion of polyurethane, or in other words polyurethane foam. In that case, a relatively soft core layer 32 is created between two relatively hard outer layers 33. After curing, a lightweight but highly stable construction is obtained, so that additional beads and ribs can be dispensed with in wall parts made by this production process.

Figure 4:
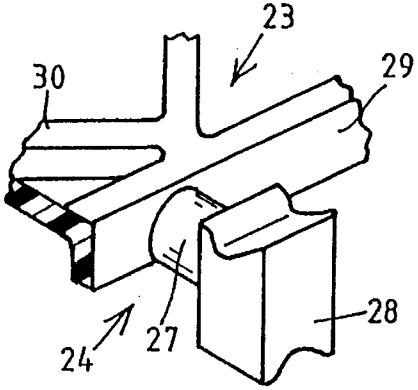
FIG. 4 is a fragmentary, perspective view of a protrusion disposed on a bottom element.
Figure 2:
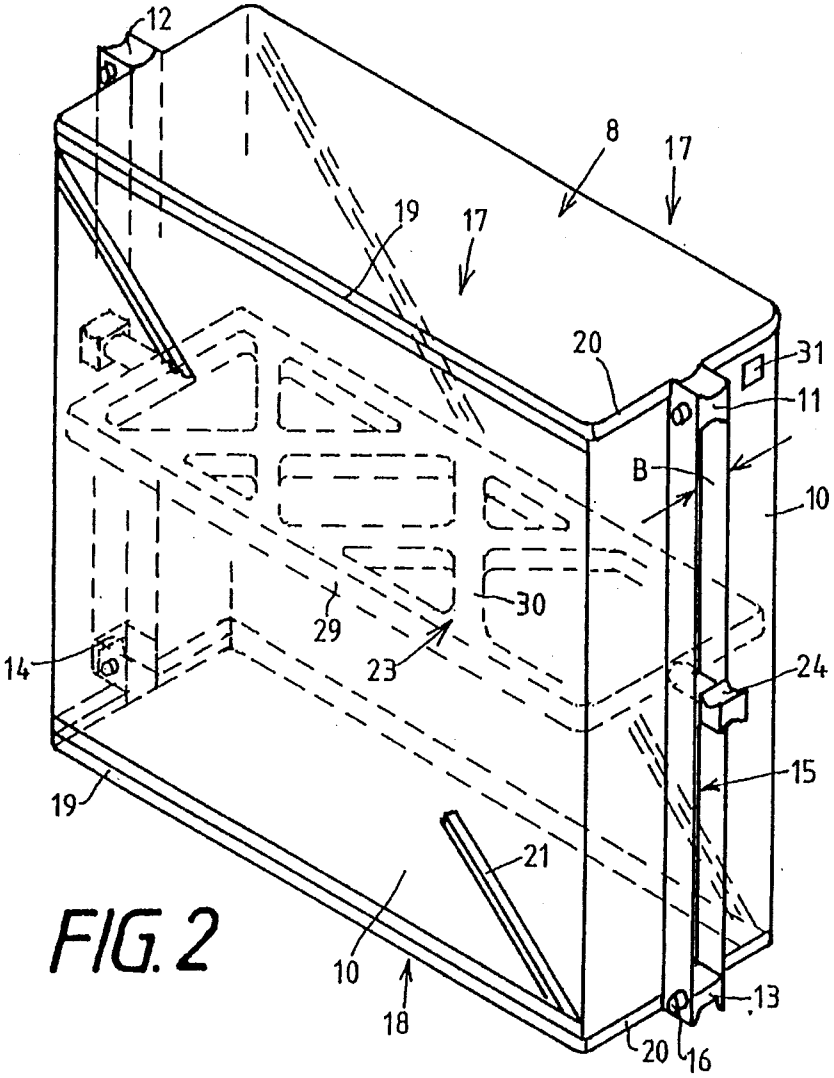
FIG. 2 is an enlarged perspective view of the transport container according to the invention.

As is shown particularly in FIGS. 2 and 4, the bottom element 23 has a lattice-like structure. A frame 29 is made rigid with struts 30, so that a lightweight but stable component is created. The lateral protrusions 24 are disposed on the frame 29 and extend through the guide gaps 15 disposed between the wall parts 10. As is shown in FIG. 4, these protrusions 24 have a round segment 27 and a shaped part 28 adjoining it which has an essentially polygonal shape. The round segment 27 is guided in guide gaps 15 and makes it possible to swivel the bottom element 23 about its longitudinal axis, so that sliver residues, for instance, can be evacuated at the bottom. On one hand the shaped part 28 serves as a connection element for the pressure feet 6 disposed on the drawing frame 1 or on the linear unit 3, so that the bottom element 23 is securely guided during the filling operation. On the other hand, the shaped part 28 locks the bottom element 23 in the guide gaps 15 while it is being rotated about its longitudinal axis.

Figure 3:
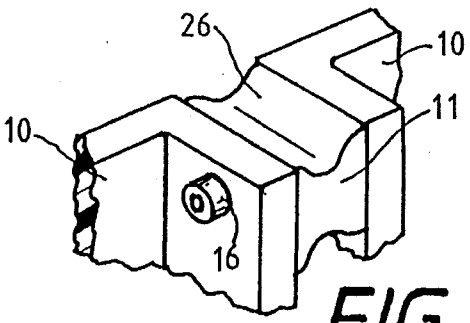
FIG. 3 is a fragmentary, perspective view of a region of upper spacer elements.
Figure 9:
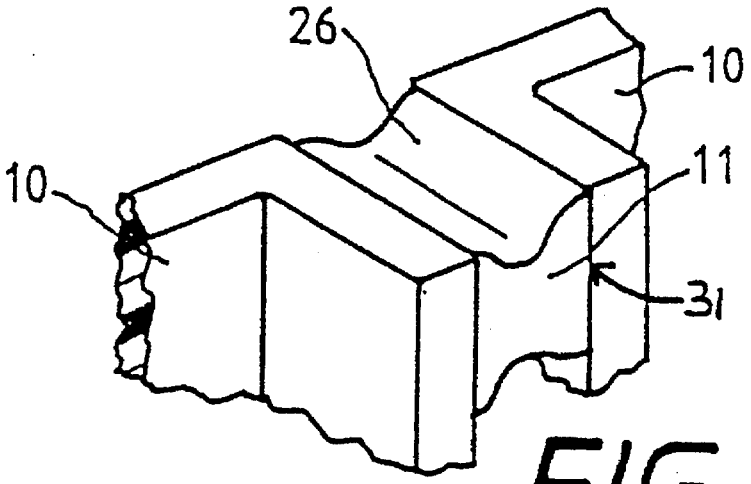
FIG. 9 is a view similar to FIG. 3, in which the upper spacer element is glued to the wall parts.

As is shown in FIG. 3, at least one of the upper spacer elements 11 or 12 has a sliver receiving device 26, for instance in the form of a notch in which the end of the sliver can be deposited in defined fashion after the conclusion of the filling operation and held ready for the ensuing processing operation. The spacer element 11 is attached between the wall parts 10 with the screw bolt 16. Alternatively, as illustrated in FIG. 9, the attachment may be effected by an adhesive connection 31.

Figure 5:
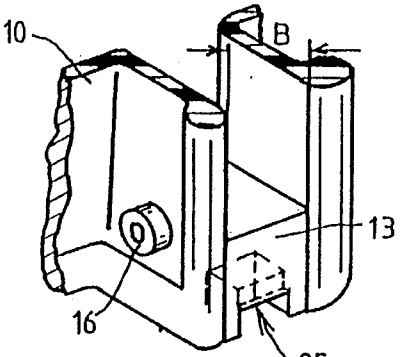
FIG. 5 is a fragmentary, perspective view of a region of lower spacer elements.
Figure 10:
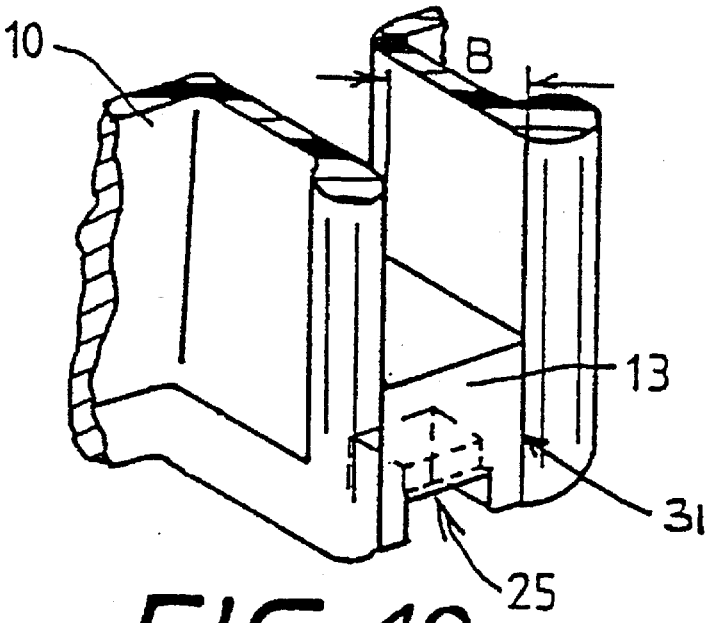
FIG. 10 is a view similar to FIG. 5, in which the lower spacer element is glued to the wall parts.

As is shown in FIG. 5, a device 25 for the engagement of a manipulator or the like is also disposed on at least one of the lower spacer elements 13 and/or 14, so that the transport container 8 can be optimally manipulated at any time, whether during the filling operation at the drawing frame, during transport from the drawing frame to an open-end spinning machine, or during can changing at the open-end spinning machine. The spacer element 13 is attached between the wall parts 10 with the screw bolt 16. Alternatively, as illustrated in FIG. 10, the attachment may be effected by the adhesive connection 31.

Through the use of encoded or encodable data carriers 31, which are disposed, for instance, on one or both wall parts 10, identification of the transport container 8 or of its contents is possible. Such encoding enables automatic assignment of the transport container by means of an automatic transporting and manipulating device.

The transport container 8 of the invention is overall a container that is economically constructed, is easily handled both in the region of drawing frames (cards) and in the region of open-end spinning machines, and is thus optimally suited for automated transport.

I claim:

1. A transport container for textile packages, comprising:

a vertically displaceable bottom element; and a wall surrounding said bottom element and having a given length, said wall being formed of at least two separately formed wall parts, said wall parts being joined together and extend over all of said given length, and said wall having guide gaps formed by a spacing between said wall parts over large portions of said given length, for guidance of said bottom element.

2. The transport container according to claim 1, wherein said wall has a rectangular outline.

3. The transport container according to claim 1, including spacer elements inserted between said at least two wall parts and having a width predetermining the width of said guide gaps.

4. The transport container according to claim 1, wherein said at least two wall parts are two identically constructed wall parts.

5. The transport container according to claim 1, wherein said bottom element has lateral protrusions reaching through said guide gaps for guiding said bottom element in said guide gaps.

6. The transport container according to claim 3, including screw bolts, said at least two wall parts being detachably joined together by said spacer elements and said screw bolts.

7. The transport container according to claim 3, wherein said at least two wall parts are undetachably joined together by said spacer elements.

8. The transport container according to claim 3, wherein said spacer elements include upper and lower spacer elements, and at least one of said upper spacer elements has a sliver receiving device.

9. The transport container according to claim 3, wherein said spacer elements include upper and lower spacer elements, and at least one of said lower spacer elements has a device that enables the engagement of a manipulator.

10. The transport container according to claim 5, wherein said bottom element includes a frame and struts.

11. The transport container according to claim 5, wherein said protrusions have a round segment and an end with an essentially polygonally shaped part.

12. The transport container according to claim 1, wherein at least said at least two wall parts are formed of a thermoplastic.

13. The transport container according to claim 12, wherein said at least two wall parts are injection molded.

14. The transport container according to claim 1, wherein said at least two wall parts are formed of expanded polyurethane and have two relatively hard outer layers and a relatively soft core layer between said outer layers.

15. The transport container according to claim 14, wherein said core layer is substantially thicker than said outer layers.

16. The transport container according to claim 12, including beads and ribs adding rigidity to said at least two wall parts.

17. The transport container according to claim 1, wherein said at least two wall parts have an upper edge and a longitudinal guide in the vicinity of said upper edge.

18. The transport container according to claim 1, wherein said at least two wall parts have a lower edge, a longitudinal guide in the vicinity of said lower edge, and an inwardly-pointing bearing edge for said container bottom.

19. The transport container according to claim 1, including an encoded or encodable data carrier disposed on said wall.

* * * * *